US008002676B1

(12) United States Patent
Corona et al.

(10) Patent No.: US 8,002,676 B1
(45) Date of Patent: Aug. 23, 2011

(54) STRIKEABLE EXERCISE APPARATUS

(76) Inventors: Mariano Corona, Woodland Hills, CA (US); Yolanda Corona, Woodland Hills, CA (US)

( * ) Notice: Subject to any disclaimer, the term of this patent is extended or adjusted under 35 U.S.C. 154(b) by 0 days.

(21) Appl. No.: 12/835,225

(22) Filed: Jul. 13, 2010

(51) Int. Cl.
*A63B 69/34* (2006.01)

(52) U.S. Cl. ..... 482/83; 482/148

(58) Field of Classification Search ..... 482/83–90, 482/148; 206/315.1, 315.91, 223, 526, 575, 206/579; 434/247; 273/342, 406; 473/457, 473/468, 565–567, 596
See application file for complete search history.

(56) References Cited

U.S. PATENT DOCUMENTS

| | | | | |
|---|---|---|---|---|
| 3,450,592 | A * | 6/1969 | Conrad et al. | 473/595 |
| 3,722,885 | A * | 3/1973 | Leaf | 273/440 |
| 4,093,217 | A * | 6/1978 | Piccini | 473/451 |
| 4,667,954 | A * | 5/1987 | McCorkle | 482/86 |
| 4,673,179 | A * | 6/1987 | Pengler | 482/148 |
| 4,732,378 | A * | 3/1988 | LeFebvre et al. | 482/88 |
| 5,154,431 | A * | 10/1992 | Hayashi et al. | 473/471 |
| 5,232,368 | A * | 8/1993 | Morgia | 434/247 |
| 5,277,421 | A | 1/1994 | Rewolinski | |
| 5,342,267 | A | 8/1994 | Adams et al. | |
| 5,380,002 | A * | 1/1995 | Spector | 473/519 |
| 5,501,649 | A * | 3/1996 | Queppet | 482/88 |
| 5,897,469 | A | 4/1999 | Yalch | |
| 6,730,004 | B2 * | 5/2004 | Selsam | 482/93 |
| D506,137 | S * | 6/2005 | Durivage | D9/527 |
| 7,156,791 | B2 * | 1/2007 | Edwards | 482/148 |
| 7,297,077 | B1 | 11/2007 | Battaglino | |
| 7,314,436 | B1 | 1/2008 | Rubin | |
| 2008/0096740 | A1 * | 4/2008 | Nichols | 482/121 |

FOREIGN PATENT DOCUMENTS

GB 2451844 A * 2/2009

* cited by examiner

*Primary Examiner* — Loan Thanh
*Assistant Examiner* — Daniel F Roland
(74) *Attorney, Agent, or Firm* — Crossley Patent Law; Mark A. Crossley

(57) ABSTRACT

The strikeable exercise apparatus provides several exercise benefits, all capable of being practiced indoors or out. The apparatus provides a plurality of bats and a plurality of hexagons, each of which may be padded. The bats' shapes are shaped to provide as much striking area as is possible. The abrupt taper disposed at the cylinder second end provides as much room for the handle as is possible within the length of each bat. The apparatus is especially useful in providing for the development of core power, as well as power in the extremities by providing that each dual-handled hexagon can be wielded as is chosen, as can each bat. The plurality of weights of the bats and hexagons importantly provide for the strongest as well as the not so strong to enjoy a myriad of activities that provide for both core power development and extremity development.

16 Claims, 3 Drawing Sheets

STRIKEABLE EXERCISE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

A great many exercise devices are known in the arts, and most serve a useful purpose in helping to condition a practitioner and maintain at least some degree of physical fitness. One genre of exercise is especially used to promote power. Power is typically defined as the combination of speed and strength. While explosive speed and strength exercises were often practiced by necessity in the past, sedentary lifestyles and athletic pursuits have recently revived specialized conditioning for power. One form of such exercises relates to striking the ground and other objects with some sort of tool, mallet, ball, or other appropriate device. For example, many have recently practiced striking a sledge hammer or the like into the ground, but this form of exercise requires that those involved exercise outdoors only, especially if the device they are wielding is of significant mass. What has been needed is inexpensive, basic indoor equipment that will allow a practitioner to lift, strike, stretch, and perform other appropriate exercises indoors. The present apparatus fulfills this need.

FIELD OF THE INVENTION

The strikeable exercise apparatus relates to exercise devices and more especially to indoor exercise apparatus that provide for lifting, stretching, and striking indoors.

SUMMARY OF THE INVENTION

The general purpose of the strikeable exercise apparatus, described subsequently in greater detail, is to provide a strikeable exercise apparatus which has many novel features that result in an improved strikeable exercise apparatus which is not anticipated, rendered obvious, suggested, or even implied by prior art, either alone or in combination thereof.

To attain this, the strikeable exercise apparatus provides several exercise benefits, all capable of being practiced indoors. The apparatus further provides a plurality of bats and a plurality of hexagons. The bat is padded. The hexagon may also be padded. Each is appropriate for indoor use. The bats and hexagons may be used with any given mat, with such being well known in the exercise arts. The bats are experimentally determined and importantly provided in a length of about 30 inches. The bats are provided in a range of about 2½ pounds to about 35 pounds. The bats' shapes are critical due to providing as much striking area as is possible. For this reason, the bat length is substantially comprised of the extended cylinder that is of constant diameter. The abrupt taper disposed at the cylinder second end provides as much room for the handle as is possible within the length of each bat.

A term popularly used is core power. Core power typically relates to the torso and hips and buttocks. The present apparatus is especially useful in providing for the development of core power, as well as power in the extremities by providing that each hexagon can be wielded as is chosen, as can each bat. Additionally, extremities are exercised based upon the chosen use of each of the bats and hexagons, with uses actually only limited to imagination. The plurality of weights of the bats and hexagons therefore importantly provide for the strongest as well as the not so strong to enjoy a myriad of activities that provide for both core power development and extremity development, without extreme cost and area constraints.

Thus has been broadly outlined the more important features of the improved strikeable exercise apparatus so that the detailed description thereof that follows may be better understood and in order that the present contribution to the art may be better appreciated.

An object of the strikeable exercise apparatus is to provide for power training indoors or outdoors.

Another object of the strikeable exercise apparatus is to build body core power.

A further object of the strikeable exercise apparatus is to build extremity power.

An added object of the strikeable exercise apparatus is to provide for flexibility exercises.

And, an object of the strikeable exercise apparatus is to provide a plurality of bats and hexagons of various masses.

Yet another object of the strikeable exercise apparatus is to provide inexpensive exercise choices.

These together with additional objects, features and advantages of the improved strikeable exercise apparatus will be readily apparent to those of ordinary skill in the art upon reading the following detailed description of presently preferred, but nonetheless illustrative, embodiments of the improved strikeable exercise apparatus when taken in conjunction with the accompanying drawings.

In this respect, before explaining the current embodiments of the improved strikeable exercise apparatus in detail, it is to be understood that the strikeable exercise apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved strikeable exercise apparatus. It is therefore important that the claims be regarded as including such equivalent constructions insofar as they do not depart from the spirit and scope of the strikeable exercise apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the strikeable exercise apparatus generally designated by the reference number 10 will be described.

Figure 1:
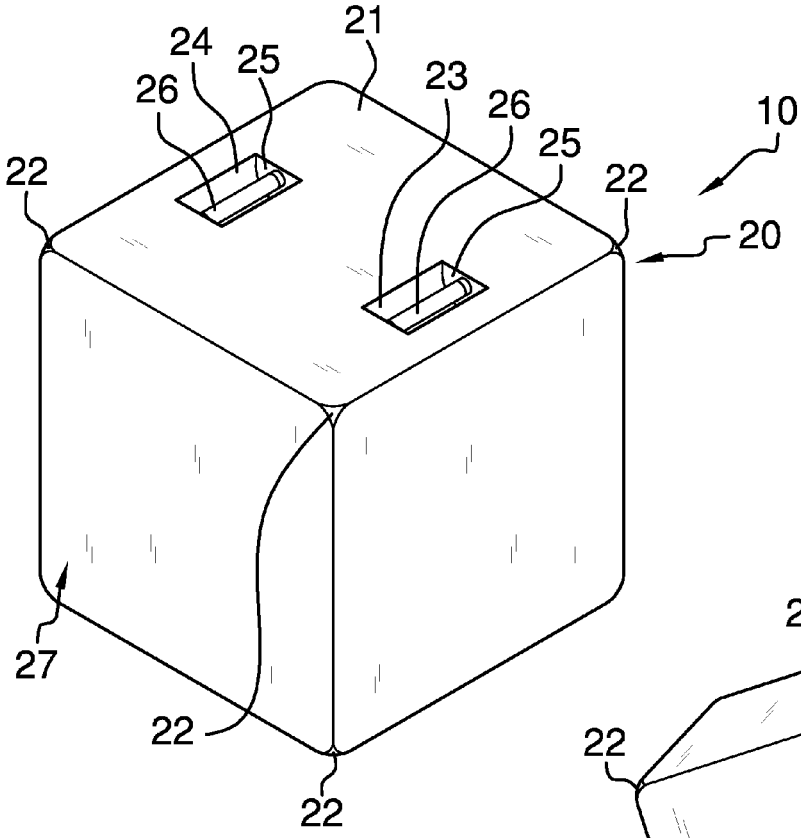
FIG. 1 is a perspective top view of the hexagon.
Figure 2:
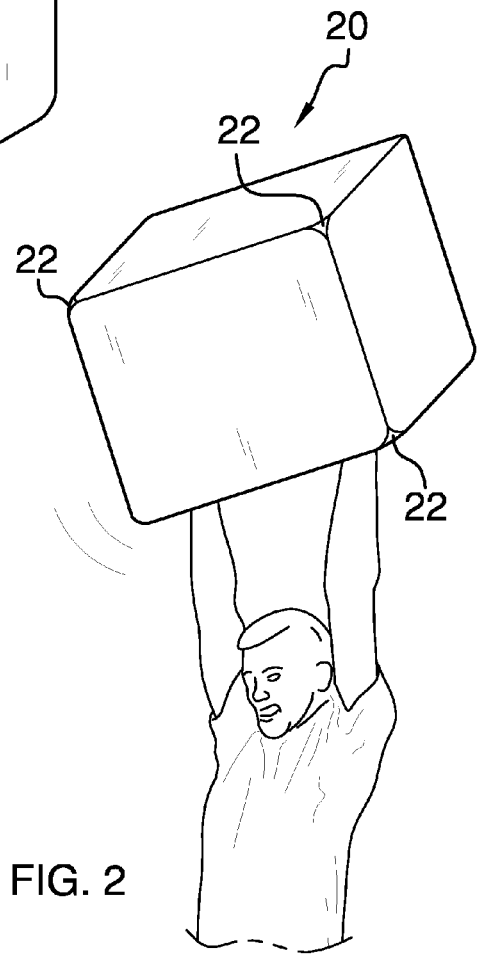
FIG. 2 is a perspective view of the hexagon in use.

Referring to FIGS. 1 and 2, the apparatus 10 partially comprises a plurality of hexagons 20. Each hexagon 20 has a different mass. Each hexagon 20 optionally comprises a padded exterior 27. Each hexagon further comprises an octet of spaced apart rounded corners 22.

Referring again to FIG. 1, each hexagon further comprises a top 21. Each top 21 comprises a pair of spaced apart semicircular recesses. The recesses are comprised of a first semicircular recess 23 and a second semicircular recess 24. Each semicircular recess has a pair of vertical spaced apart recessed ends 25. A rounded handle 26 is disposed between each pair of vertical spaced apart ends 25.

Figure 3:
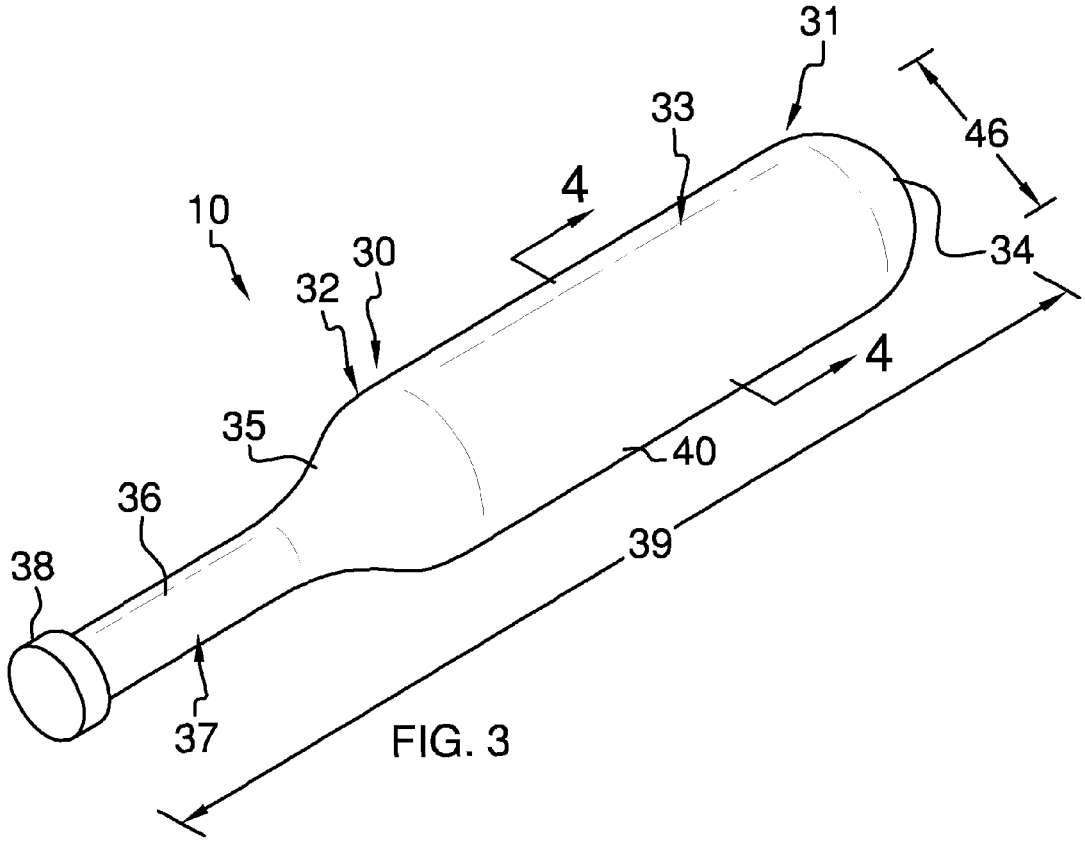
FIG. 3 is a perspective view of the bat.

Referring to FIG. 3, the apparatus 10 also comprises a plurality of bats 30. Each bat 30 has a different mass. Each bat 30 further comprises a length 39 of about 30 inches. Each bat 30 also comprises an extended cylinder 33 having a first end 31 spaced apart from a second end 32 and a constant diameter 46. A cushioned exterior 40 is disposed on the extended cylinder 33. The rounded end 34 is disposed on the extended cylinder 33 first end 31. An abrupt taper 35 is disposed on the extended cylinder 33 second end 32. The handle 36 is extended from the extended cylinder 33 second end 32. The handle butt 38 is disposed outwardly on the handle 36.

Figure 4:
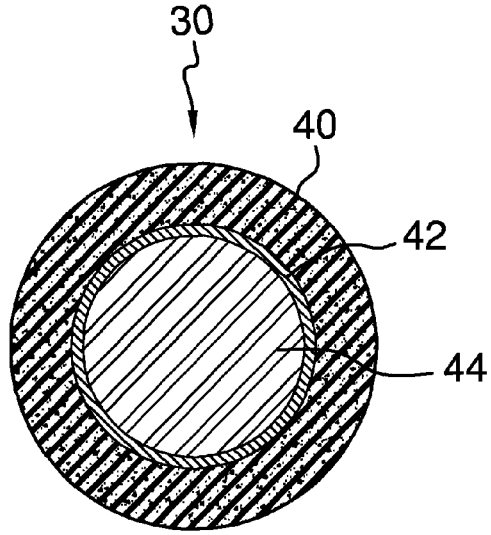
FIG. 4 is a cross sectional view of FIG. 3, taken along the line 4-4.

Referring to FIG. 4, the cushion 37 is optionally disposed exteriorly on the handle 36. The core support 42 is disposed within and throughout the length 39 each bat 30. A weight 44 is disposed within each core support 42.

Figure 5:
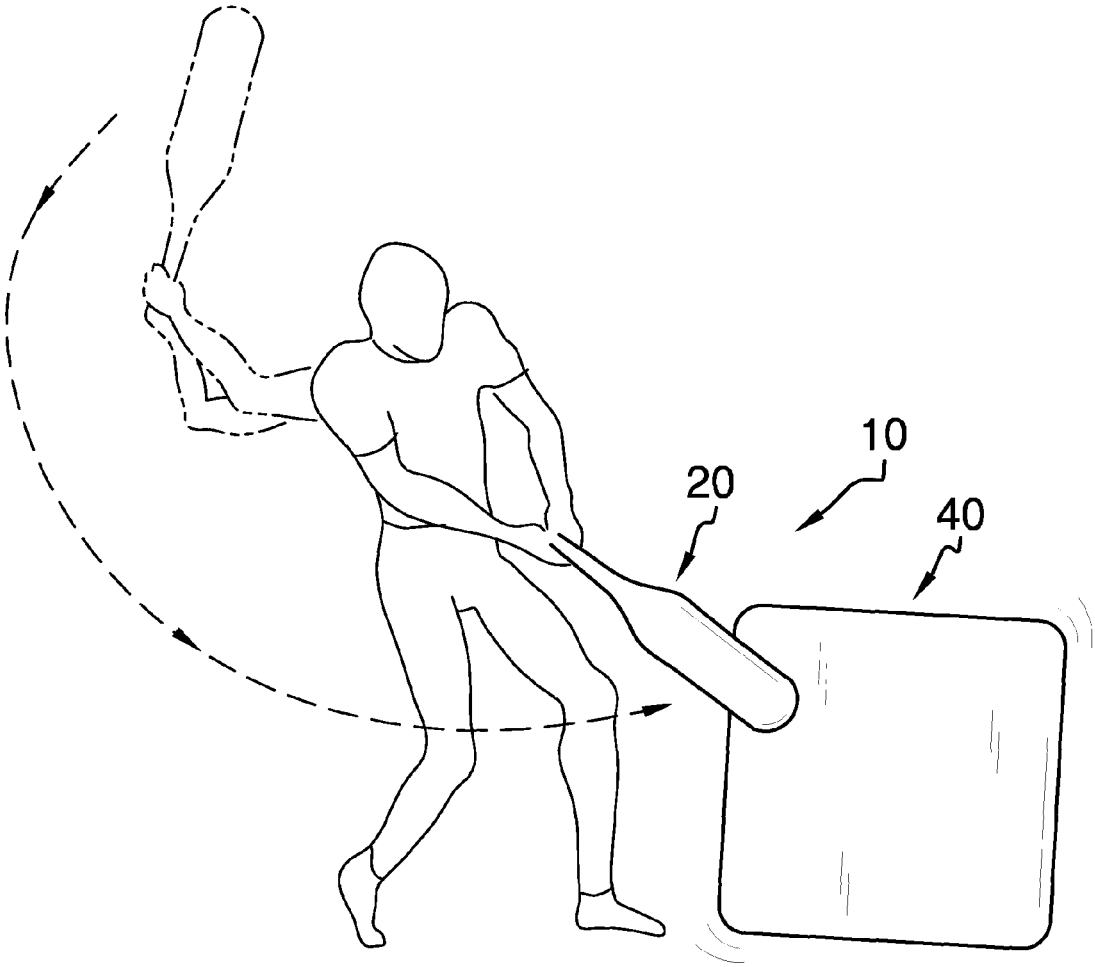
FIG. 5 is a perspective view of the apparatus in use.

Referring to FIG. 5, the both the apparatus 10 bat 30 and hexagon 20 are in use with the user striking the hexagon 20 with the bat 20.

With respect to the above description then, it is to be realized that the optimum dimensional relationships for the parts of the strikeable exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the strikeable exercise apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the strikeable exercise apparatus may be used.

Therefore, the foregoing is considered as illustrative only of the principles of the strikeable exercise apparatus. Further, since numerous modifications and changes will readily occur to those skilled in the art, it is not desired to limit the strikeable exercise apparatus to the exact construction and operation shown and described, and accordingly, all suitable modifications and equivalents may be resorted to, falling within the scope of the strikeable exercise apparatus.

What is claimed is:

1. A strikeable exercise kit comprising, in combination:

a plurality of hexagons, each hexagon having a different mass, each hexagon further comprising:
- an octet of spaced apart rounded corners;
- a top;
- a pair of spaced apart semicircular recesses disposed in the top, comprising a first semicircular recess and a second semicircular recess, each semicircular recess having a pair of vertical spaced apart recessed ends;
- a rounded handle disposed between each pair of vertical spaced apart ends;

a plurality of bats, each bat having a different mass, each bat further comprising:
- a length of about 30 inches;
- an extended cylinder having a first end spaced apart from a second end;
- a cushioned exterior on the extended cylinder;
- a rounded end disposed on the extended cylinder first end;
- an abrupt taper disposed on the extended cylinder second end;
- a handle extended from the extended cylinder second end;
- a cushion disposed exteriorly on the handle;
- a handle butt disposed outwardly on the handle;
- a core support disposed within and throughout the length of each bat;
- a weight disposed within each core support.

2. The kit according to claim 1 wherein the weight disposed within each core support is further limited to the extended cylinder.

3. The kit according to claim 1 wherein the handle further comprising an outwardly disposed cushion.

4. The kit according to claim 2 wherein the handle further comprising an outwardly disposed cushion.

5. The kit according to claim 1 wherein the extended cylinder further comprises a constant diameter.

6. The kit according to claim 2 wherein the extended cylinder further comprises a constant diameter.

7. The kit according to claim 3 wherein the extended cylinder further comprises a constant diameter.

8. The kit according to claim 4 wherein the extended cylinder further comprises a constant diameter.

9. The kit according to claim 1 wherein each hexagon further comprises a padded exterior.

10. The kit according to claim 2 wherein each hexagon further comprises a padded exterior.

11. The kit according to claim 3 wherein each hexagon further comprises a padded exterior.

12. The kit according to claim 4 wherein each hexagon further comprises a padded exterior.

13. The kit according to claim 5 wherein each hexagon further comprises a padded exterior.

14. The kit according to claim 6 wherein each hexagon further comprises a padded exterior.

15. The kit according to claim 7 wherein each hexagon further comprises a padded exterior.

16. The kit according to claim 8 wherein each hexagon further comprises a padded exterior.

* * * * *